US006813872B2

(12) United States Patent
Gray et al.

(10) Patent No.: US 6,813,872 B2
(45) Date of Patent: Nov. 9, 2004

(54) APPARATUS FOR CONTROLLING HORSES

(76) Inventors: Arthur A. Gray, 19 Naples Dr., West Seneca, NY (US) 14224; Robert Siegelman, 23 Jessica Pl., Roslyn Heights, NY (US) 11577

( * ) Notice: Subject to any disclaimer, the term of this patent is extended or adjusted under 35 U.S.C. 154(b) by 93 days.

(21) Appl. No.: 10/179,044

(22) Filed: Jun. 25, 2002

(65) Prior Publication Data

US 2004/0159082 A1 Aug. 19, 2004

(51) Int. Cl.[7] ..... B68B 1/04
(52) U.S. Cl. ..... 54/36
(58) Field of Search ..... 54/6.1, 6.2, 16, 54/36

(56) References Cited

U.S. PATENT DOCUMENTS 5,966,911 A * 10/1999 Gray et al. ..... 54/36
6,151,872 A * 11/2000 Rasmussen ..... 54/36
6,349,527 B1 * 2/2002 Keppick ..... 54/36

FOREIGN PATENT DOCUMENTS

GB 2222357 A * 3/1990 ..... B68B/5/00

* cited by examiner

*Primary Examiner*—Michael J. Carone

*Assistant Examiner*—Elizabeth Shaw

(74) *Attorney, Agent, or Firm*—Howard J. Greenwald P.C.

(57) ABSTRACT

An apparatus for controlling a horse with an ultimate strength of at least about 480 pounds; the apparatus contains a line with a proximal end, a distal end, and fastening device. The line contains a portion made of three layers of nylon webbing connected to each other; this portion of the line has a length of at least about 6 inches.

21 Claims, 5 Drawing Sheets

TO DRIVER

APPARATUS FOR CONTROLLING HORSES

FIELD OF THE INVENTION

A rein for controlling horses which has improved strength characteristics.

BACKGROUND OF THE INVENTION

In applicants' U.S. Pat. No. 5,966,911, there is described and claimed A device for controlling a horse comprising a line with a proximal end and a distal end, wherein said line comprises: (a) a first layer of material joined to a second layer of material, (b) a first filament, a second filament, a third filament, and fourth filament disposed between said first layer of material and said second layer of material and connected to said first layer of material and contiguous with both said first layer of material and said second layer of material, wherein said first filament, said second filament, said third filament, and said fourth filament extend through an opening formed in one of said first layer of material and said second layer of material and are connected to a means for removably connecting said line to a horse's bit; (c) a first crimping sleeve disposed around said first filament, said second filament, said third filament, and said fourth filament, wherein said crimping sleeve is disposed above said second layer of material; and (d) a strap comprised of fastening means. The entire disclosure of such United States patent is hereby incorporated by reference into this specificaiton.

As is disclosed in such United States patent, when riding a horse, lines are essential for controlling the horse; these lines are referred to as lines in harness racing but are often referred to as "reins" in other applications; and, in the remainder of this specification, reference will only be made to "lines" for simplicity of representation.

These lines are well known to those skilled in the art. By way of illustration and not limitation, some typical reins are disclosed in U.S. Pat. Nos. 5,442,900, 5,148,656 (training reins), U.S. Pat. No. 5,094,062 (flex rein), U.S. Pat. No. 3,604,183, and the like. The disclosure of each of these United States patents is hereby incorporated by reference into this specification.

Typically the lines are buckled to rings at each end of a bit in the horse's mouth; the lines or reins work together to establish a primary link and means of communication between the horse and the driver, jockey, or rider. By using the lines to exert or release pressure on the bit, the driver relays commands to the horse. Depending upon the individual horse's temperment and what conditions exist, various amounts of pressure are applied to the lines. In racing competitions, a tremendous amount of pressure is placed on the lines.

If a line breaks away from one side of the bit, the driver loses all control of the horse; he is helpless and subject to being involved in a serious accident. The resulting dangerous situation endangers not only the horse and driver but also any other horses and drivers near the team with the broken line. This type of incident has caused serious injury and death to both man and/or horse. The worst case scenario, which happens all too often, is when a line breaks in a race or during a training mile. The break in the line occurs where the line is buckled to the bit either as a result of stress or human error.

It is an object of this invention to provide an apparatus for controlling a horse which is substantially stronger and less likely to fail than prior art devices.

SUMMARY OF THE INVENTION

In accordance with this invention, there is provided an apparatus for controlling a horse which comprises a line comprised of a steel cable disposed within a leather base, a first buckle connected to the line at a point near the distal end of the line, and a second buckle formed by looping the distal end of the line through the horse's bit.

BRIEF DESCRIPTION OF THE DRAWINGS

The invention will be described by reference to the following specification and to the drawings, in which like numerals refer to like elements, and in which.

DESCRIPTION OF THE PREFERRED EMBODIMENTS

Figure 1:
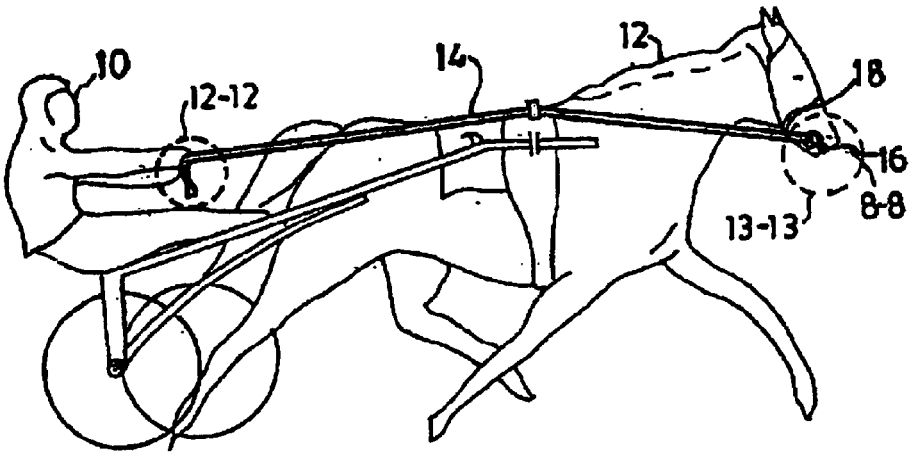
FIG. 1 is a side view of a driver controlling a harness horse by means of a line.

FIG. 1 illustrates a typical use for the line of this invention. Referring to FIG. 1, it will be seen that a driver 10 is controlling a standardbred harness horse 12 by means of a line 14 connected to a bit 16, which bit 16 is attached to bridle 18. These components and devices are well known to those skilled in the art and are described, e.g., in U.S. Pat. Nos. 5,517,949, 5,442,900, 5,435,318 (bridle), U.S. Pat. No. 5,357,735 (adjustable horse bit), U.S. Pat. No. 5,225,499 (race horse harness attachment), U.S. Pat. No. 5,148,656 (training reins), U.S. Pat. No. 5,094,062 (flex reins), U.S. Pat. No. 5,062,255 (bridle bit), and the like. The disclosure of each of these United States patents is hereby incorporated by reference into this specification.

As is well known to those skilled in the art, two lines are typically used to control the horse 12.

Figure 2:
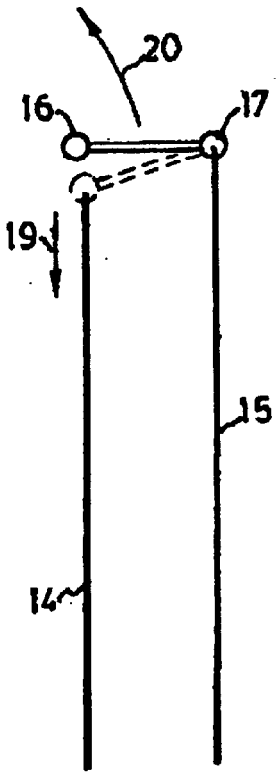
FIGS. 2 and 3 schematically illustrate how a driver can control a horse by pulling on one line or the other.
Figure 3:
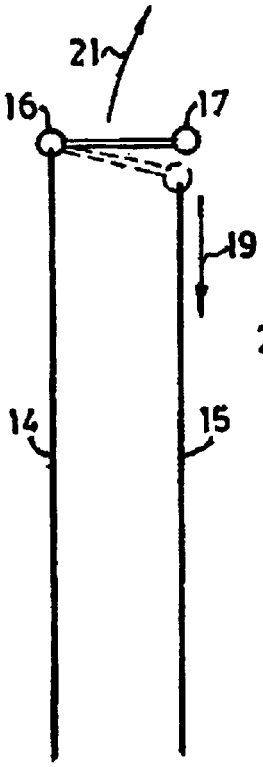

FIG. 2 schematically illustrates that when line 14 is used to pull bit 16 in the direction of arrow 19, the horse (not shown) will tend to move in the direction of arrow 20. FIG. 3 illustrates that when line 15 is used to pull bit 17 in the direction of arrow 18, the horse (not shown)/will tend to move in the direction of arrow 21. When both lines 14 and 15 are pulled with substantially equal force in the direction of arrow 19, the horse (not shown) will generally slow down or stop.

Figure 4:
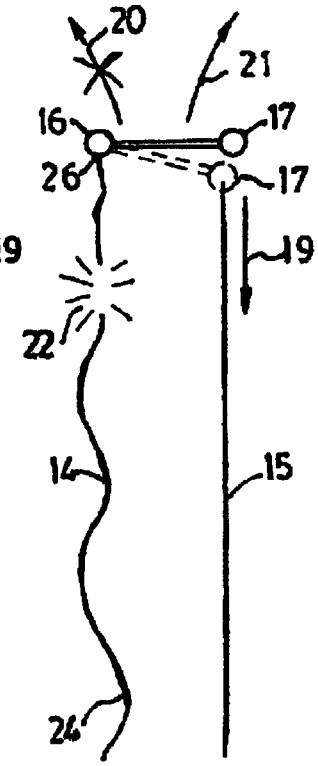
FIG. 4 schematically illustrates the loss of control over the horse which occurs when one of the lines breaks.

FIG. 4 illustrates what happens when a break 22 occurs in either line 14 or line 15. For the sake of simplicity or representation, break 22 is shown as occurring intermediate the proximal end 24 and the distal end 26 of line 14. However, most frequently, such breaks 22 occur at the distal end 26 of line 14, right near the bit 16.

Referring to FIG. 4, when break 22 occurs, the driver 10 is no longer able to either slow down or stop the horse, or to have it turn in the direction of arrow 20. His sole control, if he continues to pull on the line 15, is to have the horse turn in the direction of arrow 21. When this occurs, an extremely dangerous situation results. Several times when this has occurred, the applicant has seen the driver stand up in the sulky and jump onto the horse's back in order to regain control and prevent any injury. If a driver misses in this situation, he is in big trouble.

Figure 5:
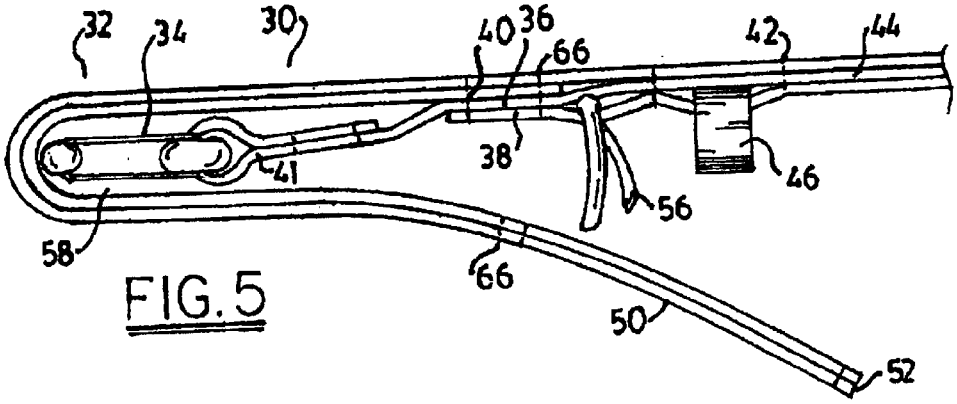
FIG. 5 is a side view of one preferred line of the invention.

FIG. 5 is a side view of a line 30 that is substantially less likely to break in use than prior art horse lines.

Referring to FIG. 5, it will be seen that, for sake of simplicity of representation, the proximal portion and the intermediate portion of the line 30 are not shown. The remainder of the horse line 30 may be conventional. As is well known to those skilled in the art, conventional horse lines generally range in length from about 92 to about 104 inches. In thoroughbred and quarter horse racing, the horse lines generally range in length from about 32 to about 42 inches.

Referring again to FIG. 5, and to the preferred embodiment depicted therein, it will be seen that the proximal portion 32 of the line 30 is comprised of a snap hook 34 which can readily be connected and disconnected from a bit (not shown). These snap hooks 34 are well known to those skilled in the art and are described, e.g., in U.S. Pat. No. 5,762,282 (locking snap hook or carabiner), U.S. Pat. No. 5,738,033 (carabiner like hooks, safety hooks, and connector hardware), U.S. Pat. No. 5,727,646 (hook, bracket, carabinber, and other types of hardware that can be readily connected or disconnected), U.S. Pat. No. 5,692,306 (carabiner hook), U.S. Pat. No. 5,687,535, (hook or carabiner), U.S. Pat. No. 5,634,499 (hook or carabiner), U.S. Pat. No. 5,608,961 (carabiner hook), U.S. Pat. No. 5,570, 512 (carabiner hook), U.S. Pat. No. 5,560,441 (carabiner or quick link), U.S. Pat. Nos. 5,553,685, 5,526,896, 5,463,798 (self locking carabiner), U.S. Pat. No. 5,370,202 (snap lock or carabiner), and the like. The entire disclosure of each of these United States patents is hereby incorporated by reference into this specification.

In one embodiment, the preferred snap hook 34 is a carabiner. As is known to those skilled in the art, a carabiner is a C-shaped, load bearing hook member with a closing member at the end. See, e.g., the 1997 "Black Diamond Equipment Spring" catalog published by Black Diamond Equipment, Ltd of 2084 East 3900 South Street,Salt Lake City, Utah. At page 5, 8, and 11 of this catalog, screw lock carabiners are illustrated. At pages 7 and 12 of this catalog, snap lock carabiners are illustrated.

In another embodiment, the snap hook 34 is an stainless steel spring-gate snap hook.

In one embodiment, the snap hook 34 will withstand a force of at least about 500 pounds One such hook is sold as the "Wichard stainless steel carbiner hook" which is sold by the Inoy Company as Standard part number 2313.

Figure 6:
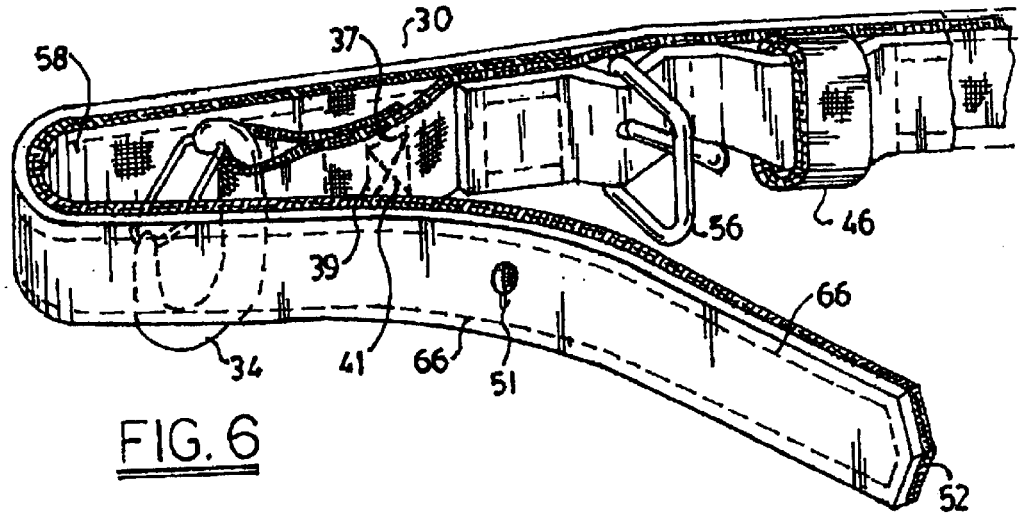
FIG. 6 is a perspective view of the line of FIG. 5.

Referring again to FIG. 5, and to the preferred embodiment depicted therein, it will be seen that snap hook 34 is connected to a line 36 which, in turn, is anchored within inner layer 38 and either intermediate layer 40 and/or outer layer 42. In the embodiment depicted in FIG. 5, a first portion 41 of line 36 is wound around snap hook 34, and a second portion 44 of the line 36 is returned past the keeper 46 and further extends an additional length (such as about an additonal 8 inches) until its end 48 (see FIG. 6)

In one preferred embodiment, the line 36 has a tensile strength of at least about 480 pounds. In this embodiment, it is preferred that line 30 be comprised of a nylon webbing. Nylon webbing material, and lines made therefrom, are well known to those skilled in the art. Reference may be had, e.g., to U.S. Pat. No. 6,318,612 (device for securing an item to a vehicle), U.S. Pat. No. 6,298,483 (protective head gear and chin pad), U.S. Pat. No. 6,287,068 (hold down strap), U.S. Pat. No. 6,276,305 (compact dog leash), U.S. Pat. No. 6,204,081 (safety utility belt), and the like. The entire disclosure of each of these United States patents is hereby incorporated by reference into this specification.

In another embodiment, not shown, the line 36 is comprised of or consists of an aramid, such as "Nomex" or "Kevlar" (manufactured by the E.I. duPont deNemours and Company of Wilmington, Del.). As is known to those skilled in the art, aramids are synthetic fibers produced from long-chain polyamides in which 85 percent of the amide linkages are attached directly to two aromatic rings.

In one preferred emboidment, line 36 is comprised of a multiplicity of nylon fibers.

Referring again to FIG. 5, and in the preferred embodiment depicted therein, it will be seen that nylon line 36 is disposed between 38 and 42.

In one embodiment, each of lines 38 and 42 comprise or consist of nylon webbing. In another embodiment, each of lines 38 and 42 are elastomer-coated nylon. As will be apparent, one may use other straps made of materials other than nylon webbing which have the desired strength, flexibility, and durablility of nylon webbing; and one may use other straps made of materials other than coated nylon that have the deisred strength, flexibility, and durability of e.g., vinyl coated nylon.

The elastomer coated nylon may be rubber-coated nylon. Rubber-coated nylon is well known to those skilled in the art. Reference may be had, e.g., to U.S. Pat. Nos. 65,223, 349, 6,017,056, 5,961,764, 5,877,256, 5,829,503, 5,768, 6790, and the like. The entire disclosure of each of these United States patents is hereby incorporated by reference into this specification.

The coated nylon may be vinyl coated nylon. Lines made from vinyl coated nylon, in whole or in part, are well known. Reference may be had, e.g., to U.S. Pat. Nos. 6,286,876, 6,280,546, 6,250,709, 6,223,508, 6,148,592, 6,082,075, 6,050,067, 5,782,070, and the like. The entire disclosure of each of these United States patents is hereby incorporated by reference into this specification.

Referring again to FIGS. 5 and 6, and to the preferred embodiment depicted therein, it will be seen that line 30 has a conventional loop forming means, such as a strap 50, which is comprised of the end 52, and an orifice 51 preferably located within about 5 inches of end 52. The line 30 also is comprised of a buckle 56 connected between lines 36 and 38; and it also comprises a keeper 46. In order to form loop 58, the end 52 of line 30 is passed through bit 16 (see FIG. 1), and thence through buckle 56, and thence through keeper 46.

Figure 8:
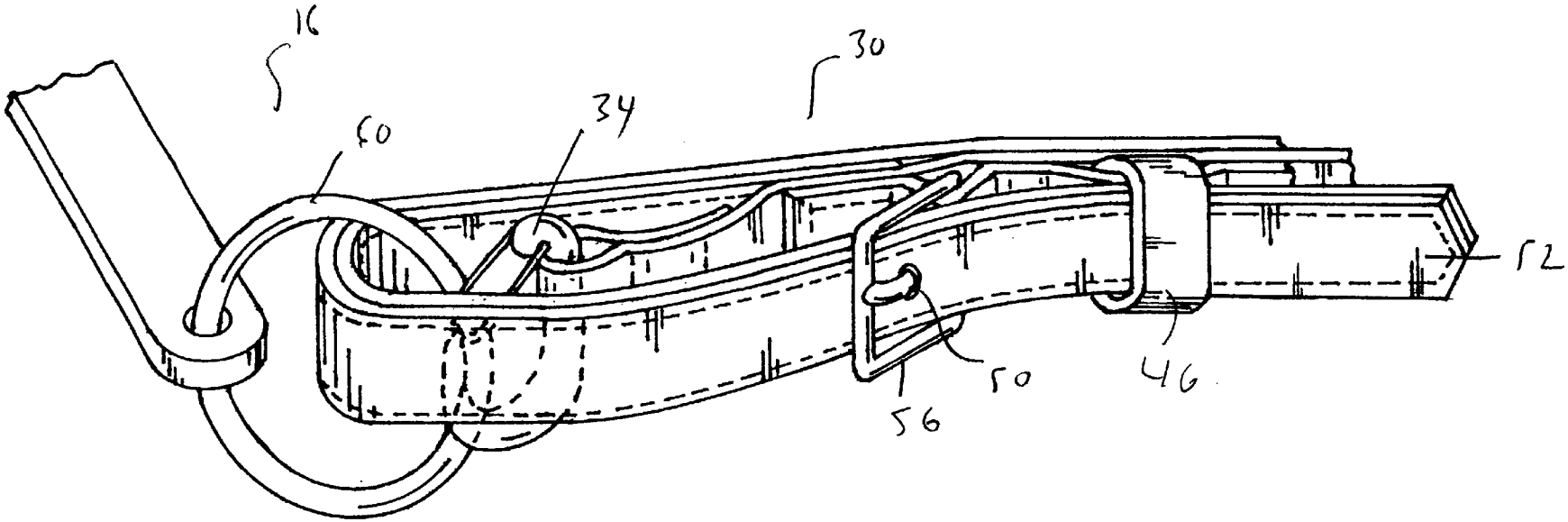
FIG. 8 is another schematic view of the line of FIG. 5.

This detail is also shown in FIG. 8, in which the bit 16 is shown as being comprised of a ring 60 and a loop 62. One may use any of the bits 16 known to those skilled in the art. Reference may be had, e.g., to U.S. Pat. Nos. 5,966,911, 5,885,377 (equestrian bit), U.S. Pat. Nos. 5,809,939, 5,528, 884, 5,357,735 (adjustable horse bit), and the like. The entire disclosure of each of these United States patents is hereby incorporated by reference into this specification.

Referring again to FIGS. 5 and 6, the preferred loop forming means is a strap. As is known to those skilled in the art, a strap is a long, narrow strip of leather or other material equipped with a buckle and/or other fastening means for binding or securing objects. Such strap retaining devices are well known and are described, e.g., in U.S. Pat. Nos. 5,621,953, 5,620,231, 5,615,923, 5,611,644, 5,607,334, 5,606,779, 5,600,875, 5,600,854, 5,598,588, 5,593,373, 5,586,705, and the like. The disclosure of each of these United States patents is hereby incorporated by reference into this specification.

Referring again to FIGS. 5 and 6, and to the preferred embodiment depicted therein, it will be seen that machine stitching straps 36, 38, and 42 and holds them tightly together. In one embodiment, the stitching used in nylon stitching.

Referring again to FIG. 6, and in the preferred embodiment illustrated therein, it will be seen that hook 34 is connected to line 36 by means of horizontal stitching 37, vertical stitching 39, and diagonal stitching 41. It is preferred, for maximum strength, that such stitching form a rectangular or square pattern with diagonally crossing lines.

Figure 7:
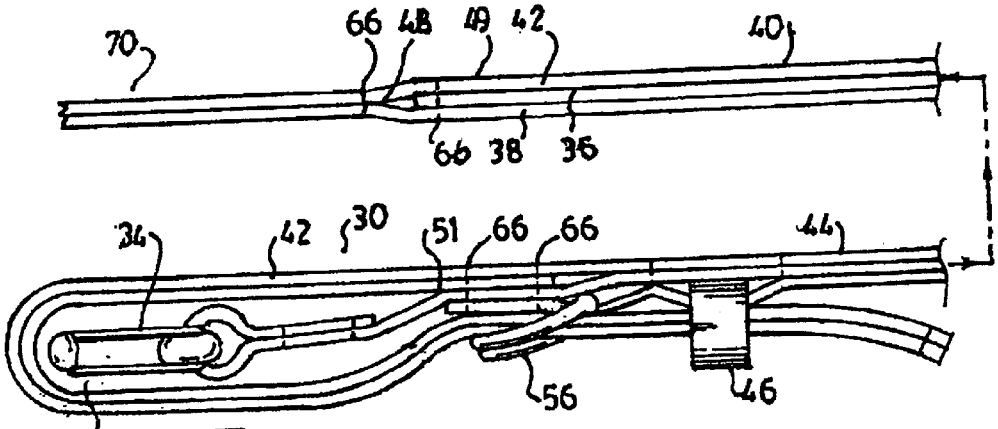
FIG. 7 is a schematic view of the line of FIG. 5.

FIG. 7 is a schematic representation of the line 30 of FIG. 5 indicating that, at about point 48, the three-member laminated structure (elements 32/36/38) ends and is joined with a two member laminated structure 70 that preferably is comprised of vinyl-coated nylon straps 38 and 42 which at joined together by nylon stitching 66.

Referring to FIG. 7, and in the preferred embodiment depicted therein, it will be seen that the three-ply section, that ends at point 48, is designated as element 49, extends from such point 48 to point 51, and has a length between such points 48 and 51 of at least about 6 inches. In one embodiment, such length is at least 9 inches. In another embodiment, such length is at least 12 inches.

Figures 9, 10, 10A, 11:
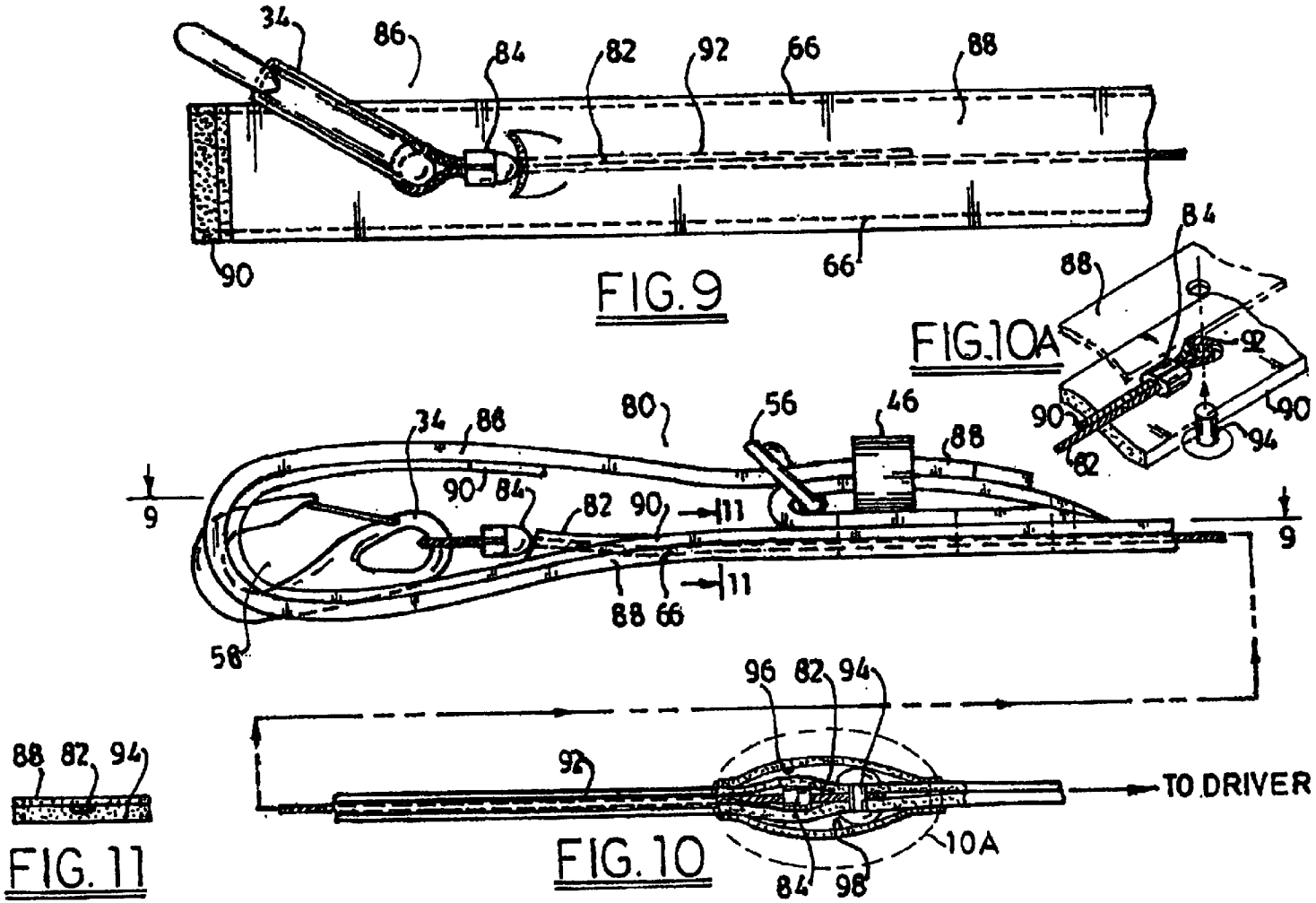
FIG. 9 is a partial schematic view of another line of the invention.
FIG. 10 is another schemaitc view of the line of FIG. 9.
FIG. 11 is an end view of the line of FIG. 10.

FIG. 9 is schematic view of another line 80 of the instant invention that is comprised of snap hook 34 connected to wire cable 82 by means of crimping sleeve 84. One may use any conventional crimping sleeve as crimping sleeve 84. Thus, by way of illustration and not limitation, one may use one or more of the crimping sleeves disclosed in U.S. Pat. Nos. 5,586,912, 5,766,234, 5,766,173, 5,761,949, 5,758, 406, 5,752,361, 5,751,535, and the like. The disclosure of each of these United States patents is hereby incorporated by reference into this specification.

The wire cable 82 preferably has a tensile strength of at least about 500 pounds. In one preferred embodiment, wire cable 82 is corrosion resistant and, e.g., may be made of stainless steel. Thus, e.g., stainless steel wire rope with 1/16" diameter may be used.

One may use other wire rope that is known to those skilled in the art. Reference may be had, e.g., to U.S. Pat. Nos. 5,716,466, 4,902,995, 4,721,051, 3,974,079, 3,857,714, and the like. The entire disclosure of each of these United States patents is hereby incorporated by reference into this specification.

In the embodiment depicted in FIGS. 9 and 10, the wire rope 82 is disposed between leather strap and leather strap 90, which are joined together by stitching. One may use any of the leather straps known to those skilled in the art. Reference may be had, e.g., to U.S. Pat. Nos. 6,089,384, 6,151,872, and the like. The entire disclosure of each of these United States patents is hereby incorporated by reference into this specification.

In the preferred embodiment depicted in FIGS. 9 and 10, the wire rope 82 is disposed in one or more channels 92 cut into the interior surface of either leather strap 88 and/or leather strap 90. The purpose of such channel(s) 92 is to secure the wire cable in place within such channel(s) 92 so that it will not migrate and contact the stitching 66. Thus, e.g., by maintaining the wire rope 82 within the channel(s) 92 during the manufacturing process, the wire rope is prevented from interfering with the stitching process.

Applicants have discovered that, without the use of such channel(s) 92, there is a risk that the wire rope 82 may damage the stitching 66 and, consequently, damage the integrity of the line 80.

In one embodiment, illustrated in FIG. 10A, the crimping sleeve 84 secures the end 90 of the wire rope 82 to form a loop 92 through which a copper rivet 94 may be inserted to firmly secure the wire rope 82 to the leather straps 88 and 90. In one emboidment, the rivet 94 is a capped rivet with a cap on both of its ends to maximize the stregnth imparted by the rivet to the assembly.

In one embodiment, illustrated in FIG. 10A, the rivet 94 extends from the outside surface of leather strap 90 to the outside surface of leather strap 88. By comparison, in the embodiment illustrated in FIG. 10, the rivet 94 only extends to the interior surfaces 96 and 98 of leather straps 88 and 90.

FIG. 11 is a partial end view of the line 80. In the preferred embodiment depicted, the channel 82 is cut into the strap 90. In another embodiment, not shown, the channel 82 is cut into the strap 88. In yet another embodiment, the channel 82 is cut into both the strap 88 and the strap 90.

Figure 12:
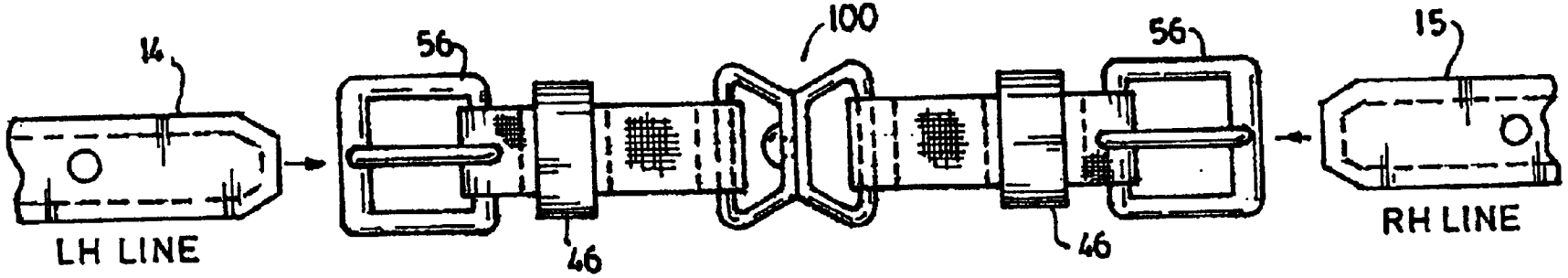
FIG. 12 is a partial schematic view of a portion of the line of FIG. 5.

FIG. 12 is a schematic illustration of how the ends of lines 14 and 15 (see FIG. 1) connect to coupler 100. The use of such couplers 100, which is well known in the art, is optional with applicants' lines.

Figure 13:
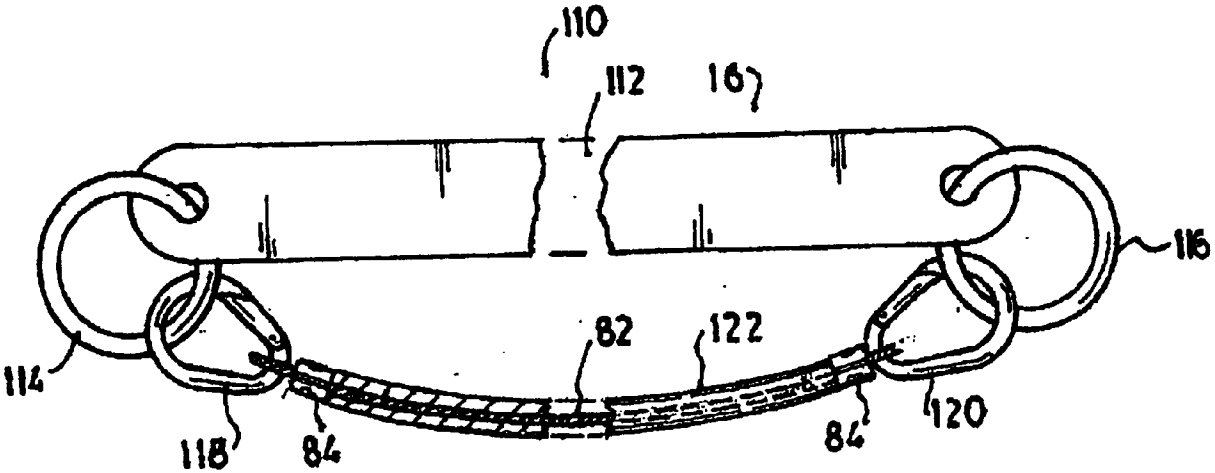
FIG. 13 is another embodiment of an attachment means which can be used in the lines of FIGS. 5 and 9.

FIG. 13 is a schematic representation of a safety device device 110 which, if bit 16 were to break at point 112, would prevent bit rings 114 and 116 from separating. In the embodiment depicted, the bit rings 114 and 116 are connected to snap hooks 118 and 120 respectively. The snap hooks 118 and 120 are connected to wire rope 82 which, in the embodiment depicted, is enclsoed within a rubber bushing 122 and is secured by crimping sleeves 84. As will be apparent, the use of this additional safety device further improves the reliability of applicant's lines.

The rein of this invention is surprisingly substantially stronger than prior art reins. When such rein assembly is tested for ultimate strength, in accordance with American Standards Testing Bureau ASTB/AS P.#1235-722 LR Standard Test, it is able to withstand a peak breaking load of at least 480 pounds. In one embodiment, the rein is capable of withstanding a peak breaking load of at least 490 pounds prior to failure. In yet another embodiment, the rein is capable of withstanding a peak breaking load of at least 500 pounds prior to failure.

By comparison, the rein assembly of U.S. Pat. No. 5,966, 911 is typically capable of withstanding a peaking breaking load of only about 420 pounds prior to failure.

It is to be understood that the aforementioned description is illustrative only and that changes can be made in the apparatus, in the ingredients and their proportions, and in the sequence of combinations and process steps, as well as in other aspects of the invention discussed herein, without departing from the scope of the invention as defined in the following claims.

We claim:

1. An apparatus for controlling a horse with an ultimate strength of at least about 480 pounds, wherein said apparatus is comprised of a wire rope connected to a first snap hook and a second snap hook, a line with a proximal end and a distal end, and fastening means connected to said line at said proximal end of said line, wherein:

(a) said fastening means is comprised of a buckle, a strap, a sleeve, and a third snap hook, wherein said third snap hook has a tensile strength of at least 500 pounds;

(b) said line is comprised a first section of said line comprised of a first outer layer of nylon webbing, a second intermediate layer of nylon webbing, and a third inner layer of nylon webbing, wherein said first layer of nylon webbing, said second layer of nylon webbing, and said third layer of nylon webbing are connected to each other;

(c) said first section of said line has a length of at least about 6 inches.

2. The apparatus as recited in claim 1, wherein said wire rope is elastomer coated wire rope.

3. The apparatus as recited in claim 2, wherein said wire rope is rubber coated wire rope.

4. An apparatus for controlling a horse with an ultimate strength of at least about 480 pounds, comprising:

a. an outer layer having a distal portion, an intermediate portion, and a proximal portion; and an inner layer having a distal portion and a proximal portion, wherein said proximal portion of said inner layer ends at a point located along said intermediate portion of said outer layer;

b. a central layer anchored between said inner layer and said outer layer to form a three member laminated structure, wherein said central layer has a distal portion and a proximal portion, and wherein said proximal portion of said central layer extends beyond said point located along said intermediate portion of said outer layer, and comprises an end and an intermediate section, wherein said end is joined to said intermediate section to form a loop in said proximal portion of said central layer c. a buckle connected between said intermediate portion of said outer layer and said proximal portion of said inner layer; and d. fastening means engaged with said loop in said proximal portion of said central layer.

5. The apparatus as recited in claim 4, wherein said outer layer is comprised of nylon webbing.

6. The apparatus as recited in claim 5, wherein said inner layer is comprised of nylon webbing.

7. The apparatus as recited in claim 6, wherein said central layer is comprised of nylon webbing.

8. The apparatus as recited in claim 7, wherein said outer layer, said central layer, and said inner layer of nylon webbing is elastomer coated nylon webbing.

9. The apparatus as recited in claim 7, wherein said outer layer, said central layer, and said inner layer of nylon webbing is rubber coated nylon webbing.

10. The apparatus as recited in claim 7, wherein said nylon is an aramid.

11. The apparatus as recited in claim 10, wherein said stitching is nylon stitching.

12. The apparatus as recited in claim 4, wherein said outer layer, said central layer, and said inner layer are connected together by stitching.

13. The apparatus as recited in claim 4, herein said fastening means is a snap hook.

14. The apparatus as recited in claim 11, wherein said snap hook is a carabiner.

15. The apparatus as recited in claim 11, wherein said snap hook is a spring gate snap hook.

16. The apparatus as recited in claim 4, wherein said end of said central layer joined to said intermediate section of said central layer is joined by stitching.

17. The apparatus as recited in claim 4, wherein said proximal portion of said outer layer is formed in a loop.

18. The apparatus as recited in claim 16, wherein an orifice is provided in said proximal portion of said outer layer.

19. The apparatus as recited in claim 17, wherein said proximal portion of said outer layer passes through said buckle, and said buckle is engaged with said orifice.

20. The apparatus as recited in claim 4, further comprising a keeper connected between said intermediate portion of said outer layer and said proximal portion of said inner layer.

21. The apparatus as recited in claim 4, further comprising an intermediate layer joined to said intermediate portion of said outer layer, and joined to said proximal portion of said central layer, and joined to said proximal portion of said inner layer, and extending along and joined to said proximal portion of said outer layer.

* * * * *